US006179169B1

(12) United States Patent
Radtke

(10) Patent No.: US 6,179,169 B1
(45) **Date of Patent: *Jan. 30, 2001**

(54) AEROSOL CONTAINER CLOSURE

(75) Inventor: Charles S. Radtke, Little Ferry, NJ (US)

(73) Assignee: Precision Valve Corporation, Yonkers, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/943,556

(22) Filed: Oct. 3, 1997

Related U.S. Application Data

(63) Continuation of application No. 08/401,209, filed on Mar. 9, 1995, now abandoned.

(51) Int. Cl.[7] ..... B65D 83/14

(52) U.S. Cl. ..... 222/402.1; 222/542; 220/614; 220/619

(58) Field of Search ..... 222/397, 402.1, 222/402.21–402.25, 542; 220/619, 614, 615, 621; 53/470, 488; 413/7, 42–44, 58–62

(56) References Cited

U.S. PATENT DOCUMENTS 4,730,752 * 3/1988 Kimball et al. ..... 222/394
4,832,236 * 5/1989 Greaves ..... 222/402.1
5,016,785 * 5/1991 Greenebaum, II ..... 222/402.1
5,121,858 * 6/1992 Chong ..... 222/397
5,234,137 * 8/1993 Meuresh et al. ..... 222/402.1
5,325,985 * 7/1994 Radtke ..... 220/614 X

* cited by examiner

*Primary Examiner*—Kenneth Bomberg
(74) *Attorney, Agent, or Firm*—Kilgannon & Stedl

(57) ABSTRACT

A mounting cup for an aerosol container having radially outward extending dimples on the body portion of the mounting cup and radially inward extending indents in the skirt portion of the mounting cup; both the dimples and the indents being aligned with the longitudinal axis of the mounting cup. In the preferred form of the mounting cup, three aligned dimples and indents are spaced equidistant about the circumference of the body portion and the skirt portion, respectively. Additionally, the method of this invention comprises forming a mounting cup having dimples and indents aligned with the longitudinal axis of the mounting cup, wherein the indents are formed in the last stage of a progressive die stamping operation through displacement of the metal of the mounting cup into a recess in the outer surface of the pilot tool during the formation of the skirt portion of the mounting cup.

2 Claims, 5 Drawing Sheets

AEROSOL CONTAINER CLOSURE

This application is a continuation of Ser. No. 08/401,209 filed Mar. 9, 1995, now abandoned.

BACKGROUND

Aerosol dispensing containers have found widespread use in the packaging of fluid materials including a variety of both liquid and powdered particulate products. Such containers are provided with a valve-controlled discharge orifice and operate by the action of a volatile propellant which is confined within the container together with the product to be dispensed. Because the propellant has an appreciable vapor pressure at room temperature, the product in the closed container is maintained under super-atmospheric pressure.

A typical aerosol unit comprises a hollow cylindrical container which is tightly closed at one end and is provided with an opening at its opposite end for receiving a dispensing valve assembly. A closure, commonly referred to as a mounting cup, serves as the closure for the container and as a support for the valve assembly. Typically, the mounting cup comprises a pedestal portion for mounting the valve unit, a panel portion extending from the pedestal portion, a body portion extending from the periphery of the panel, which body portion emerges into a channel portion extending outwardly from the body, the most radially outward portion of the channel portion being the skirt portion of the mounting cup. When the mounting cup is placed in sealing position on the container, the channel is positioned over the bead surrounding the container opening and the lower portion of the body portion adjacent to the channel is flared or clinched outwardly against the container bead. To ensure adequate sealing between the closure and the container, the cup is provided with a gasket in the channel, or predominantly in the channel, of the cup.

SUMMARY OF THE INVENTION

Broadly stated, this invention comprises a gasketed mounting cup having radially outward extending protrusions or dimples on its body portion and radially inwardly extending indents or protrusions in the skirt portion of the mounting cup, which dimples and indents are aligned relative to the longitudinal axis of the mounting cup. Further the subject invention concerns a method for manufacturing a mounting cup having an irregularity in the skirt portion of the mounting cup during the stamping operation to form the mounting cup, such that it is not necessary to form the irregularity of the skirt portion in a separate operation post the stamping operation.

The present invention will be more clearly understood by referring to the drawings herein and the discussion relating thereto.

DESCRIPTION OF THE INVENTION

Figure 1A:
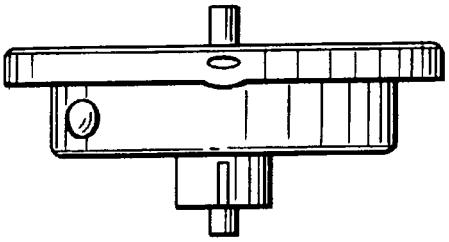
FIG. 1A PRIOR ART
FIG. 1A is a side view of the mounting cup of the prior art showing the body portion dimples and the skirt indents in a non-aligned relationship and FIG. 1B is a plan view.
Figure 2A:
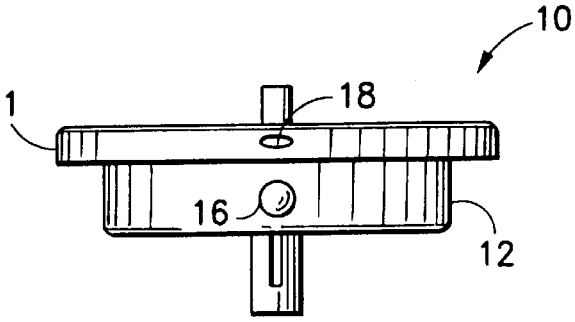
FIG. 2A is a side view of the mounting cup of this invention showing the body portion dimples and the skirt indents in an aligned relationship and FIG. 2B is a plan view.
Figure 1B:
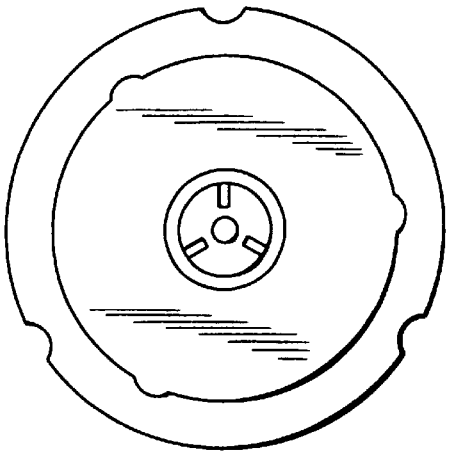
FIG. 1B PRIOR ART
Figure 2B:
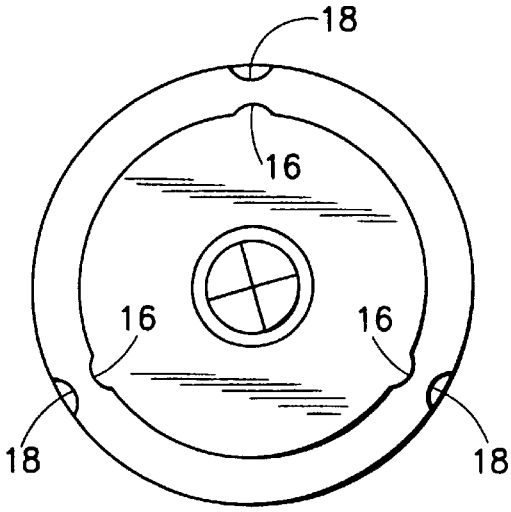

In FIG. 2A, the mounting cup, generally designated as 10, has a body portion 12 and a skirt portion 14. On the body portion 12, there are three radially outward extending dimples 16 (shown best in FIG. 2B) and three radially inward indents 18 (shown best in FIG. 2B) in the skirt portion 14 of the mounting cup 10. It is to be noted that the dimples and indents are aligned, in contrast to the non-aligned dimples and indents of the prior art.

Figure 3:
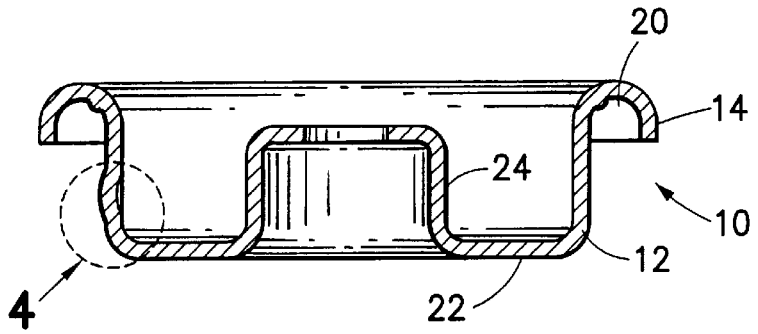
FIG. 3 is a vertical cross sectional view of the mounting cup of this invention through the longitudinal axis of the mounting cup.

In FIG. 3, the mounting cup is generally designated as 10, which mounting cup has a body portion 12 terminating at its radially outward portion in a channel portion 20 formed by the body portion 12 and the skirt portion 14, said body portion 12 merging into a profile portion 22, which profile portion merges into the pedestal portion 24 of the mounting cup. The pedestal portion 24 has the aerosol valve (not shown) crimped therein.

Figure 4:
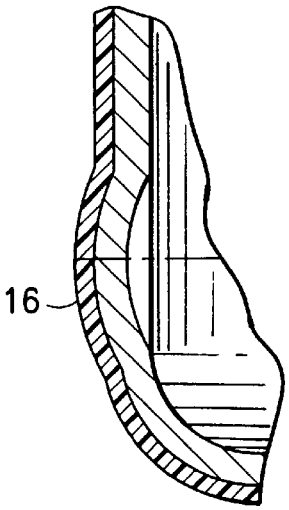
FIG. 4 is an enlarged view of the dotted circle "4" portion of the mounting cup of FIG. 3.
Figure 5:
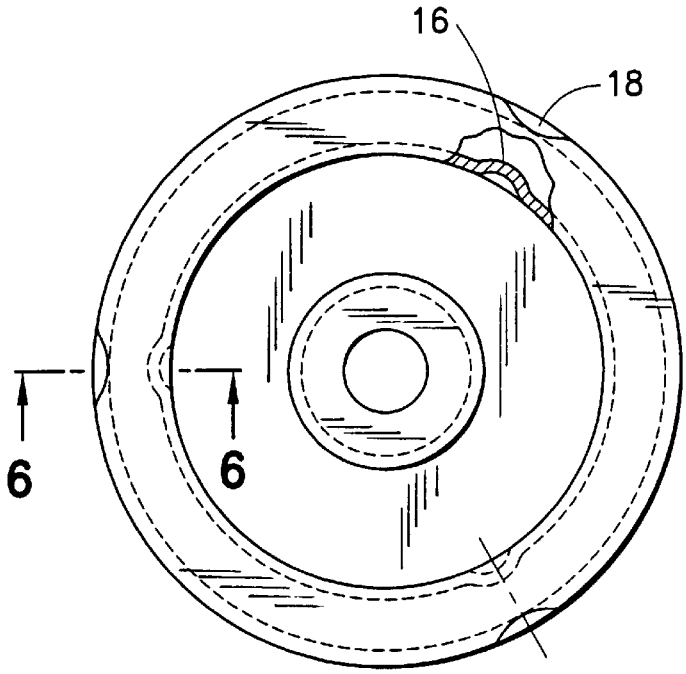
FIG. 5 is a plan view of the mounting cup of this invention.

In FIG. 4, the dimple 16 is shown in enlarged detail.

Figure 6:
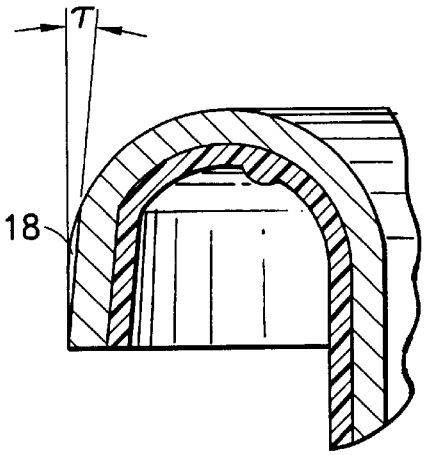
FIG. 6 is an enlarged partial view of the "6—6" of FIG. 5.

In FIG. 6, the indent 18 is shown in enlarged detail with the indent having a seven (7) degree angle from the vertical.

Figure 7:
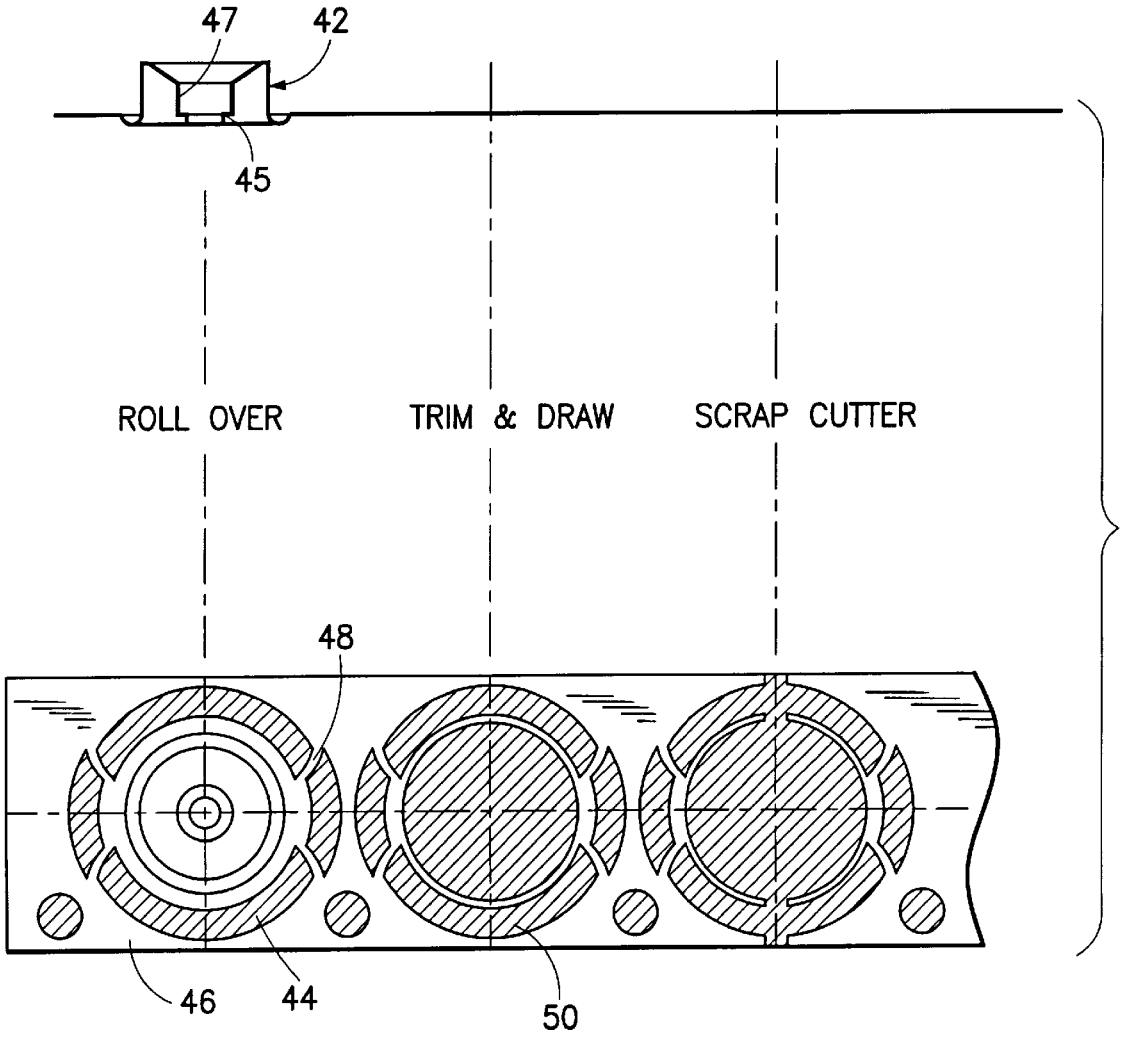
FIG. 7 is a schematic drawing of a portion of the progressive die strip used to form the mounting cup of this invention.

FIG. 7 shows in schematic a portion of the progressive die stamping operation used to form the mounting cup of this invention. In FIG. 7, mounting cup 42 has been formed through a series of progressive die stamping operations, the mounting cup being completely formed except that the pedestal portion does not have a flange formed on its opening and the skirt portion has not been formed. At the Roll Over station 44, the flange 45 is formed in the pedestal portion 47 of the mounting cup 42.

As shown at Roll Over station 44, the mounting cup 42 is still attached to the original sheet metal strip or carrier 46 through ties 48. At the Trim and Draw station 50, the mounting cup 42 is severed from the metal strip or carrier 46 and the skirt portion 62 (shown best in FIG. 8) is formed by wiping the upper cutting edge 54 (FIG. 8) against the lower cutting edge 56 in the Trim and Draw station 50. The progressive die stations preceding the Roll Over station used in the manufacture of the mounting cup of this invention may differ in commercial mounting cup manufacturing operations, however, the use of progressive die stages to form mounting cups is broadly old and well known to those skilled in the art.

In the Trim and Draw station 50 (best shown in FIG. 8) the dimpled mounting cup 42 has the indents formed in the skirt portion of the mounting cup 42 in the so-called Trim and Draw station, which indents are aligned with the dimples in the body portion of the mounting cup relative to the longitudinal axis of the mounting cup.

Figure 8A:
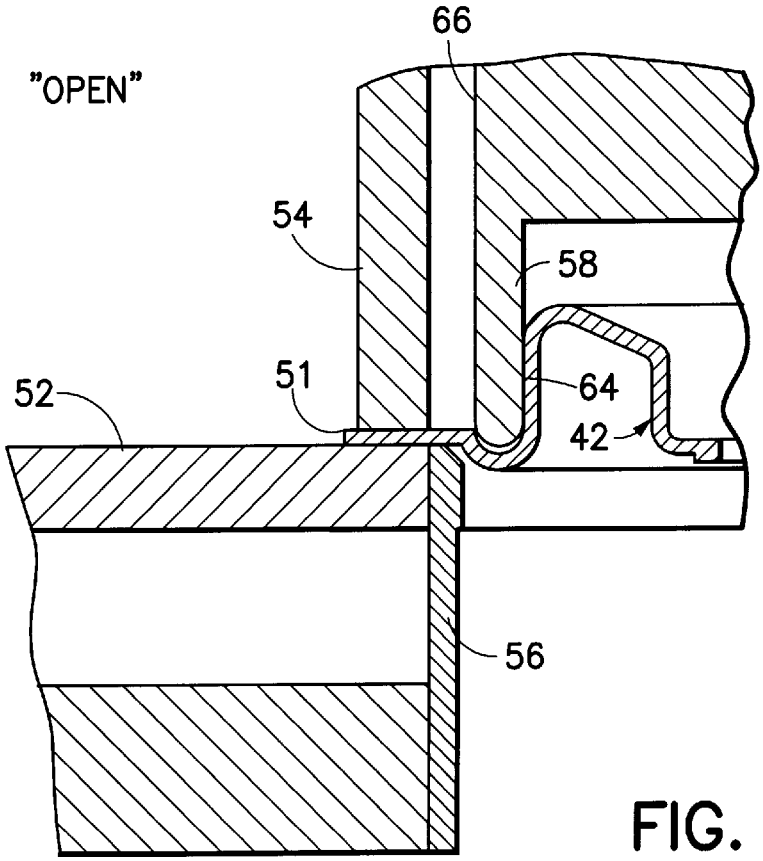
FIG. 8 is a schematic of the tool used to form the indents in the skirt portion of the mounting cup of this invention.
Figure 8B:
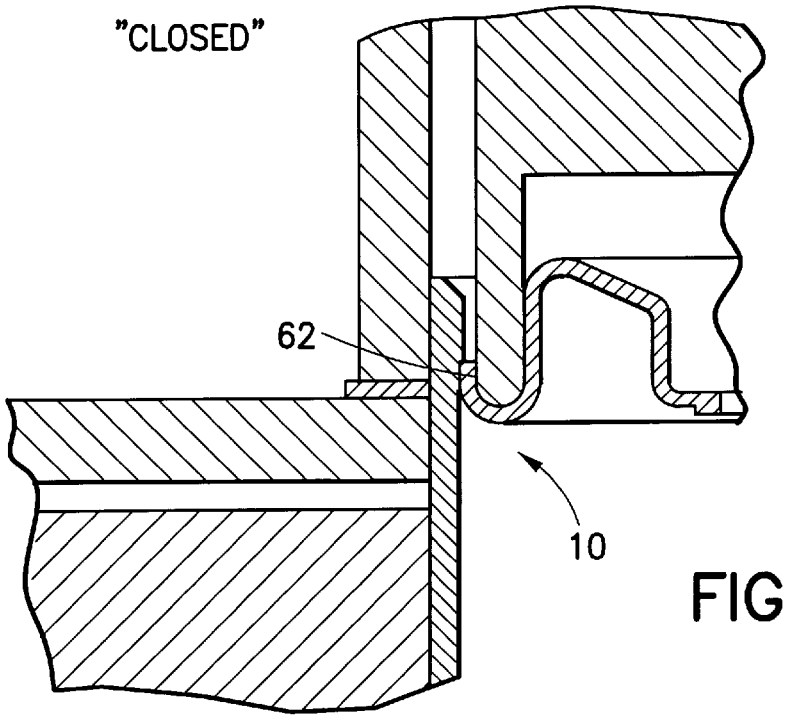
Figure 9A:
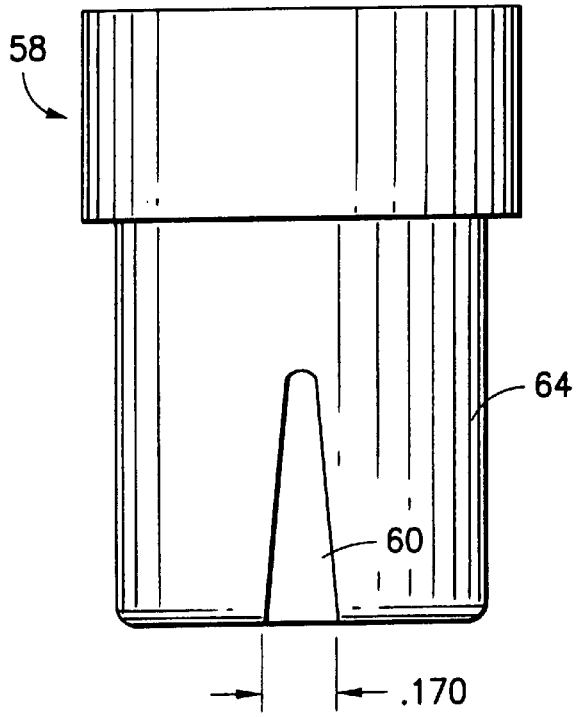
FIG. 9A is a front view of the pilot toolshown in FIG. 8.
Figure 9B:
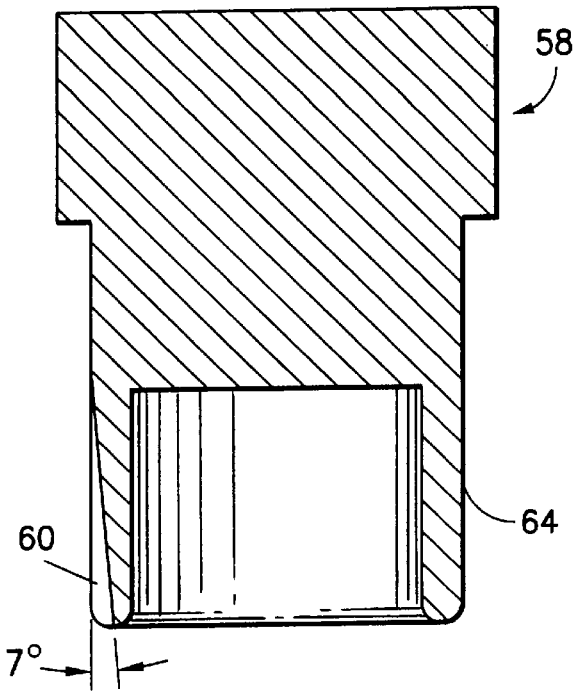
FIG. 9B is a cross-sectional view of the pilot tool of FIG. 8 through one of the grooves.
Figure 9C:
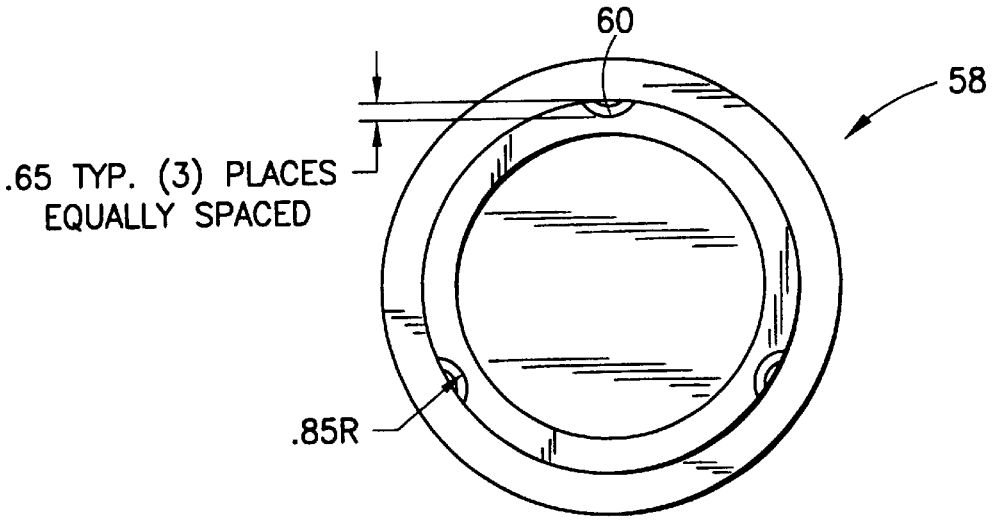
FIG. 9C is a view of the pilot tool of FIG. 8 from the nose of the tool.

FIG. 8 shows in partial schematic detail a portion of the tool used to form the indents in the skirt portion. The "OPEN" side of FIG. 8 shows the partially formed mounting cup 42 having a flat portion 51 held in place on a stripper plate 52 by upper cutting edge 54 and below by lower cutting edge 56. The pilot 58 and the upper cutting edge 54 are connected to a ram (not shown) and move downwardly in tandem, as shown in the "closed" side of FIG. 8, during the Trim and Draw step of the mounting cup formation process. As shown best in FIGS. 9A–9C, the pilot 58 has a groove 60 in its outer surface 64 which acts as a recess to receive displaced metal during the forming of the skirt portion 62 of the mounting cup; the metal displacement creating an indent in the outer surface of the skirt portion 62 of the mounting cup 10. By aligning the groove 60 in the pilot outer surface 64 with the dimple in the body portion 64 of the mounting cup 42, the resultant mounting cup will have longitudinally aligned dimples and indents.

The dimple disposed on the body portion of the mounting cup is of a size to prevent the mounting cup from being dislodged from its container prior to clinching the mounting cup to the container and the indent is of a size that the channel portion of the mounting cup is prevented from seating on the bead of a container prior to the application of the forces joining the mounting cup and container bead during the clinching operation.

It has been found satisfactory to dispose three (3) grooves 60 of the same dimension on the outer surface 64 of the pilot 58; said grooves being disposed one hundred and twenty degrees (120°) apart to thereby generate a mounting cup having three dimples and indents in alignment on the mounting cup. The grooves formed in outer surface of the pilot must be sufficiently wide so that the metal of the skirt portion of the mounting cup will flow into and partially fill the groove in order to form the indent in the skirt portion. If the groove is too narrow the metal of the skirt portion will bridge the groove and not deform into the groove with the consequence that the indent will not be formed. It has been found that configuring the grooves in the outer surface of the pilot to have a width of 0.175", an angle of 7° from the upper portion of the groove to the nose of the pilot, and a depth of 0.065" at the nose of the pilot will produce a one inch mounting cup having improved characteristics from the standpoint of stability in positioning on the bead of the container.

With the process of this invention, a mounting cup may be formed that will have uniformly dimensional dimples, one to the other, and uniformly dimensioned indents, one to the other, as well as dimples and indents that are aligned relative to the longitudinal axis of the mounting cup.

It should be understood that while the process of this invention has been described and illustrated in connection with the formation of indents on the outer surface of the skirt portion of the mounting cup, the process of this invention may be used to form any irregularity in the skirt portion of the mounting cup, regardless whether an indent or a protrusion, by the appropriate altering of the outer surface of the pilot.

I claim:

1. In a mounting cup for a pressurized container having a bead defining the container opening, the mounting cup having a centrally disposed pedestal portion for receiving an aerosol valve, a profile portion extending radially outward from the pedestal portion, a body portion extending from the terminus of the profile portion distal to the pedestal portion and extending in a direction substantially parallel to the longitudinal axis of the mounting cup, said body portion emerging into a curvilinear-shaped channel portion having a skirt portion radially outward of the body portion, said mounting cup and the container bead being joined and sealed by the application of forces during a clinching operation; the improvement comprising disposing at least three radially-outward extending dimples equally spaced on the circumference of the body portion and at least three radially-inward extending indents equally spaced on the skirt portion of the channel portion; said dimples and indents being aligned relative to the longitudinal axis of the mounting cup.

2. The mounting cup of claim 1, and further wherein the dimple disposed on the body portion is of a size to prevent the mounting cup from being dislodged from its container prior to clinching the mounting cup to the container and the indent is of a size that the channel portion of the mounting cup is prevented from seating on the bead of a pressurized the container prior to the application of the forces joining the mounting cup and container bead during the clinching operation.

* * * * *